US007290531B2

(12) United States Patent
Halsmer

(10) Patent No.: US 7,290,531 B2
(45) Date of Patent: Nov. 6, 2007

(54) INTEGRATED FUEL SUPPLY SYSTEM FOR INTERNAL COMBUSTION ENGINE

(76) Inventor: John Peter Halsmer, 3130 Middlebury La., Bloomfield Hills, MI (US) 48301

( * ) Notice: Subject to any disclaimer, the term of this patent is extended or adjusted under 35 U.S.C. 154(b) by 0 days.

(21) Appl. No.: 11/125,925

(22) Filed: May 10, 2005

(65) Prior Publication Data

US 2005/0247292 A1 Nov. 10, 2005

(51) Int. Cl.
*F02D 41/30* (2006.01)
*F02B 13/00* (2006.01)

(52) U.S. Cl. ..... 123/478; 123/481; 123/575

(58) Field of Classification Search ..... 123/520, 123/73 AD, 304, 431, 491, 437–439, 478, 123/298, 269, 276, 307, 193.6
See application file for complete search history.

(56) References Cited

U.S. PATENT DOCUMENTS 3,174,470 A * 3/1965 Von Seggern et al. ..... 123/275
3,185,452 A * 5/1965 Mennesson ..... 261/23.2
4,006,718 A * 2/1977 Konomi ..... 123/686
4,683,854 A * 8/1987 Goulet ..... 123/435
4,829,966 A * 5/1989 D'Angelo et al. ..... 123/478
4,886,026 A * 12/1989 Cook ..... 123/681
5,474,047 A * 12/1995 Cochard et al. ..... 123/491
5,803,053 A * 9/1998 Pflieger et al. ..... 123/516
6,035,822 A * 3/2000 Suzuki et al. ..... 123/276
6,116,211 A * 9/2000 Suzuki et al. ..... 123/305
6,223,715 B1 * 5/2001 Suzuki ..... 123/294
6,374,812 B1 * 4/2002 Wiese ..... 123/520
6,378,486 B1 * 4/2002 Spiegel et al. ..... 123/298
6,378,490 B1 * 4/2002 Ottowitz et al. ..... 123/305
6,460,509 B1 * 10/2002 Muramatsu et al. ..... 123/305
6,463,907 B1 * 10/2002 Hiltner ..... 123/304
6,499,463 B1 * 12/2002 Berriman et al. ..... 123/431
6,508,233 B1 * 1/2003 Suhre et al. ..... 123/478
6,540,210 B2 * 4/2003 Satterfield ..... 261/62
6,571,764 B1 * 6/2003 Ottowitz et al. ..... 123/305
6,612,282 B2 * 9/2003 Yu ..... 123/262
6,725,827 B2 * 4/2004 Ueda et al. ..... 123/295
6,851,663 B2 * 2/2005 Satterfield ..... 261/23.2
6,910,455 B2 * 6/2005 Sczepanski et al. ..... 123/193.6
6,959,696 B2 * 11/2005 Shears et al. ..... 123/516
2001/0007251 A1 * 7/2001 Hehnke ..... 123/588
2003/0111063 A1 * 6/2003 Iida ..... 123/527
2005/0011486 A1 * 1/2005 Cueman ..... 123/304

* cited by examiner

*Primary Examiner*—Hai Huynh
(74) *Attorney, Agent, or Firm*—Ronald L. Hofer

(57) ABSTRACT

An electronic fuel injection system is combined with a carburetor in a carbureted internal combustion engine. The resulting air/fuel induction system comprises a carburetor air/fuel induction system in combination with an electronic fuel injection system which uses the carburetor of the carburetor system as the air valve for the electronic fuel injection system. The carburetor system and the electronic fuel injection systems are interconnected, preferably so that the mixture cut-off of the carburetor system is employed to shut off fuel flow in the carburetor to the air stream for the induction manifold and to simultaneously turn on the electronic fuel injector system. Either manual or automatic interconnection can be employed in the present invention.

8 Claims, 1 Drawing Sheet

INTEGRATED FUEL SUPPLY SYSTEM FOR INTERNAL COMBUSTION ENGINE

BACKGROUND OF THE INVENTION

The present invention relates to a system for supplying an air fuel mixture to an internal combustion engine and is particularly well suited for retrofit of a carbureted aircraft engine.

Although the engines of modern automobiles commonly use electronic fuel injection systems to supply fuel for combustion, the internal combustion engines of aircraft generally use carburetors or mechanical fuel injection systems. Although it is well known that electronic fuel injection systems can be programmed to adjust to temperature, pressure, load and other conditions to automatically provide the appropriate mixture of fuel and air, electronic fuel injection systems are suspect for use in aircraft without additional back-up components. However, computer and electrical power components required by electronic fuel injection systems adds additional expense and complexity.

It would be desirable if there were a practical way an aircraft engine could be provided with a more efficient and effective electronic fuel injection system which is backed up by a separate, already existing fuel induction system. This would allow a practical way to convert an older, carbureted aircraft to a modern, electronic fuel injection system with an adequate back up system. Furthermore, although carbureted air fuel systems are generally reliable, it still would be advantageous if an alternative air/fuel supply system could be provided for such aircraft, particularly if the alternative system had advantages such as automatic mixture adjustment, better starting characteristics, improved fuel economy, improved performance, and so forth. Of course, it would also be desirable where the add-on system is an improvement over the carbureted system, if the add-on induction system could become the primary system and the carbureted system the alternative system.

Accordingly, the present invention provides an add-on, electronic fuel injection system as an air/fuel induction system for carbureted aircraft engines without sacrificing any of the advantages of the carbureted system. Generally speaking, a modern electronic fuel injection system will have many advantages over an older, carbureted system, such as fuel efficiency, improved engine life, better cooling control, easier operation, no carburetor ice issues, and so forth. Further understanding of the present invention will be had from the following disclosure and claims taken in conjunction with the attached drawing.

SUMMARY OF THE INVENTION

In accordance with the present invention, an electronic fuel injection system is combined with a carburetor in a carbureted internal combustion engine. The resulting air/fuel induction system comprises a carburetor air/fuel induction system in combination with an electronic fuel injection system which uses the carburetor of the carburetor system as the air valve for the electronic fuel injection system. The carburetor system and the electronic fuel injection systems are interconnected, preferably so that the mixture cut-off of the carburetor system is employed to shut off fuel flow in the carburetor to the air stream for the induction manifold and to simultaneously turn on the electronic fuel injector system. Either manual or automatic interconnection can be employed in the present invention.

DETAILED DESCRIPTION

Figure 1:
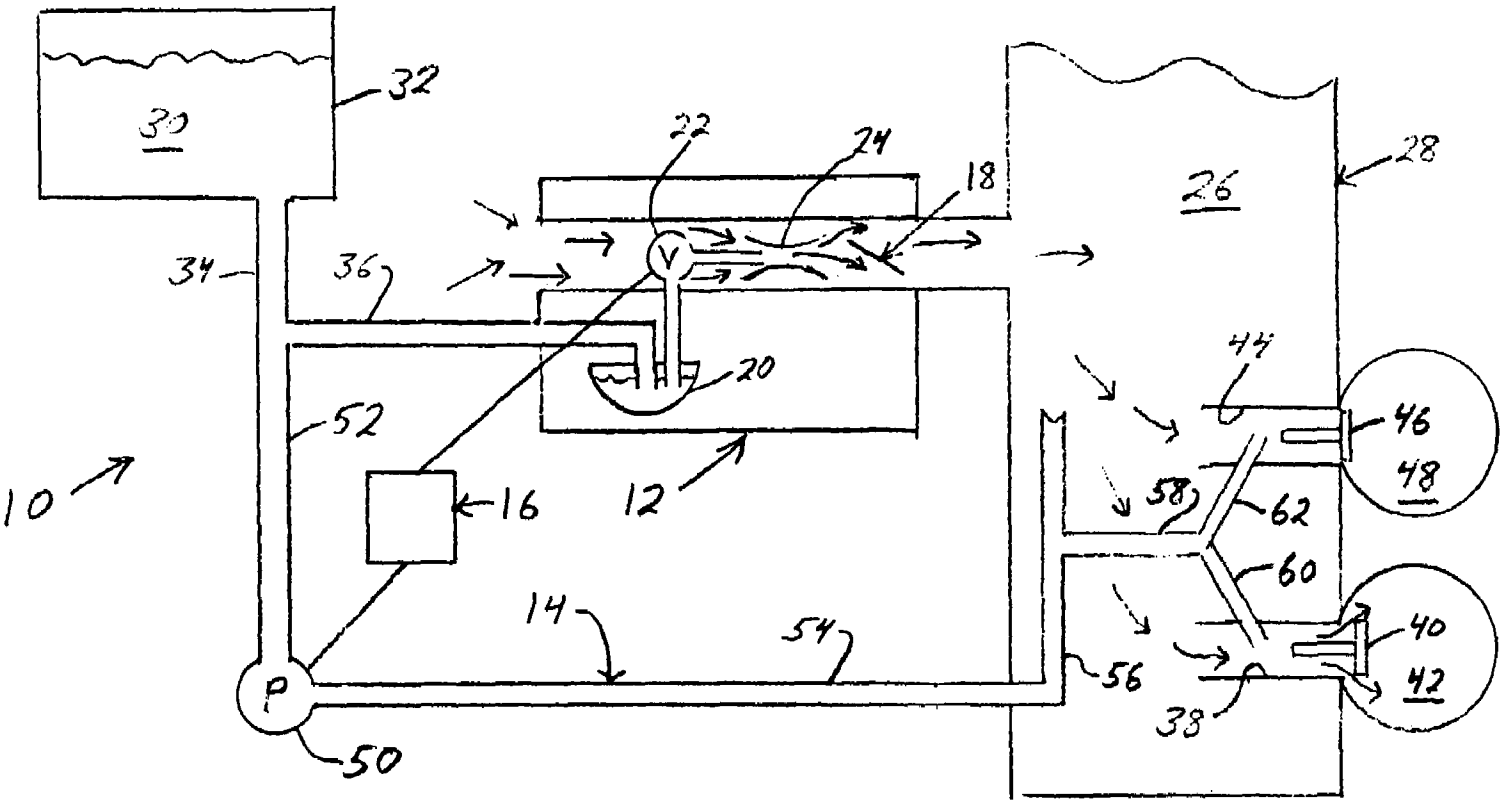
FIG. 1 is a somewhat schematic view illustrating a preferred embodiment of the present invention.

Now referring to FIG. 1, an air/fuel induction system for an internal combustion engine is illustrated and designated by the numeral 10. It will, of course, be appreciated that while the preferred embodiment of the present invention is described herein in the context of an aircraft engine having a plurality of cylinders, the present invention may be employed in conjunction with engines used for other than aircraft purposes, and, of course, the exact number of cylinders in the engine is not critical. However, air/fuel induction system 10 is particularly well adapted for use with an aircraft engine because of the requirements for such engines.

Broadly speaking air/fuel induction system 10 comprises a carburetor induction system 12, an electronic fuel injection system 14, and control system 16.

Carburetor induction system 12 is conventional and has air valve 18, float bowl 20, mixture cut off valve 22, and venturi 24. Air valve 18 controls the quantity of air flowing through carburator induction system 12 while float bowl 20 provides fuel to mixture cut off valve 22 which adjusts the amount of fuel drawn into venturi 24 for mixing with air flowing therethrough. The air/fuel mixture of carburetor induction system 12 flows into intake manifold 26 of associated engine 28.

Fuel 30 for carburetor induction system 12 is provided by fuel tank 32, which is in fluid communication with float bowl 20 of carburetor induction system 12 through fuel lines 34 and 36. In normal operation of carburetor induction system 12, fuel 30 is supplied from float bowl 20 through, and at the mixture setting selected by, mixture cut off valve 22 to venturi 24 wherein fuel 30 is mixed with air, the air/fuel mixture then being supplied to intake manifold 26 and thence to intake port 38 for induction past valve 40 for intake into cylinder 42. A second intake port 44 with associated valve 46 and cylinder 48 is also illustrated in the figure, it being understood that any desired number of ports, valves and cylinders may be suitably used without departing from the present invention.

Carburetor induction system 12 can be of any conventional or non-conventional type. A broad range of carburetor induction systems can be used in the present invention so long as the system has an air valve and is effective to provide an appropriate air/fuel mixture to intake manifold 26. For example, the air valve can be positioned downstream or upstream of the venturi. Also, a mixture valve without a cut off feature can be used so long as a further valve is provided to shut off fuel flow to the induction air stream. The system could also include means for stopping fuel flow to the carburetor bowl when the electronic injection system is in use to eliminate the possibility of over-filling the float bowl during flight oscillations and vibrations during extended periods of non-use of the carburetor system.

It will also be appreciated by those skilled in the art that fuel may be fed from the fuel tank into the carburetor by means of gravity as might be the case in a high wing aircraft installation. However, a low pressure fuel pump may be used to provide fuel pressure where required, for example in a low wing aircraft installation.

Electronic fuel injection system 14 comprises a high pressure fuel pump 50 which is in fluid communication with, and draws fuel 30 from fuel tank 32 through fuel lines 34 and 52. Fuel pump 50 provides fuel under suitable pressure through fuel injector supply line 54 to intermediate fuel injector lines 56 and 58, which, in turn, supply fuel 30 to electronic fuel injectors 60 and 62 located in intake ports 38 and 44 respectively. Electronic fuel injectors 60 and 62 are electronically controlled in any suitable manner as is well known in the art to provide the correct amount of fuel for each intake port for the current operating conditions. Of course, fuel injectors 60 and 62 inject fuel into their associated intake ports 38 and 44 for supply past valves 40 and 46 and into associated cylinders 42 and 48. It will be appreciated by those skilled in the art that a broad range of fuel injectors and fuel injector systems are suitable for use herein and that the specific fuel injector system used is not critical. For example, a single injector may be used to provide fuel to intake manifold 26 rather that the individual injectors for each cylinder. The specific location of fuel injectors in intake ports, intake plenums or directly into the cylinder is optional.

Air/fuel induction system 10 further includes control system 16 which is connected to carburetor induction system 12 and electronic fuel injector system 14 so that one selectively operates either carburetor induction system 12 or electronic fuel injection system 14. In operation, when mixture cut off valve 22 is moved to the fuel cut off position, electronic fuel injection system 16 is turned on. Fuel remains in float bowl 20 but is no longer supplied to venturi 24. Air continues to pass through air valve 18 as selected by throttle position and into manifold 26 where it is mixed with fuel supplied by fuel injectors 60 and 62 in intake ports 38 and 44. As is well illustrated in FIG. 1, fuel injector system 14 relies on air valve 18 of carburator induction system 16 for control of air into intake manifold 26 to provide air to be combined with injected fuel.

As will be appreciated by those skilled in the art, the present invention provides an alternative air/fuel injection system which is straight-forward and can be economically installed as original equipment or as a retrofit improvement to an existing engine, using the existing carburetor as the air valve for the fuel injection system. The system is particularly well-suited for use in conjunction with aircraft engines. The system provides a carbureted air/fuel induction system which can maintain fuel in the float bowl of the carburetor to facilitate changing from the injection system to the carburetor system with minimal engine hesitation. An independent electronic fuel injection cut-off switch may be used, if desired, to ensure completely independent carburetion operation, i.e., to ensure that the electronic fuel injection system is inoperative when it is desired to use the carburetor injection system. In an alternative embodiment, fuel can be drawn from the float bowl for the injection system. However, it is desirable to maintain fuel in the float bowl so that the system can be changed from the electronic fuel injection system to the carburetor system with minimal engine hesitation. Further advantages of this invention will be apparent to those skilled in the art.

What is claimed is:

1. An air/fuel induction system for an internal combustion engine of an aircraft, the air/fuel induction system comprising a carbureted fuel induction system having an air valve and an electronic fuel injection system, both of which systems including a common intake manifold in fluid communication with said air valve of said carburetor, said system including a control connected to the mixture cut-off of the carburetor system which activates said electronic fuel injector system when moved to the mixture cut-off position.

2. The system of claim 1, wherein said electronic fuel injection system is retrofit onto a carbureted aircraft engine.

3. The system of claim 2, wherein said engine has a plurality of cylinders each having an intake port and said fuel injection system has at least one injector associated with each of said intake ports.

4. The system of claim 2 wherein said fuel injector system comprises one or more fuel injectors which inject fuel into said common intake manifold.

5. The system of claim 2 wherein said engine has 4 cylinders.

6. The system of claim 2 wherein said engine has 6 cylinders.

7. The system of claim 2 wherein said engine has 8 cylinders.

8. The system of claim 2 wherein said engine is an air-cooled engine.

* * * * *